United States Patent [19]

Perrott

[11] 4,437,807

[45] Mar. 20, 1984

[54] WHEELED TRAILER FRAME CARRYING UNIT ATTACHMENT FOR LIFT TRUCK

[75] Inventor: Lynn F. Perrott, Portland, Oreg.

[73] Assignee: Scott S. Corbett, Jr., Portland, Oreg.

[21] Appl. No.: 412,504

[22] Filed: Aug. 30, 1982

Related U.S. Application Data

[63] Continuation of Ser. No. 174,519, Aug. 1, 1980, abandoned.

[51] Int. Cl.[3] ..... B66F 9/18

[52] U.S. Cl. ..... 414/620; 294/67 BB; 294/86 R; 414/678; 414/741; 414/742; 414/783

[58] Field of Search ..... 414/103, 107, 619, 620, 414/621, 622, 678, 680, 741, 742, 754, 783; 410/5, 6; 294/67 BB, 86 R; 269/71, 152, 156

[56] References Cited

U.S. PATENT DOCUMENTS

| | | | |
|---|---|---|---|
| 2,583,714 | 1/1952 | Smith | 269/152 X |
| 2,583,877 | 1/1952 | Peyron | 269/152 X |
| 2,827,690 | 3/1958 | Brown | 269/71 X |
| 3,044,647 | 7/1962 | Hopfeld | 414/620 |
| 3,370,723 | 2/1968 | Czarnecki et al. | 414/754 X |
| 3,905,495 | 9/1975 | Wayne | 414/783 X |

FOREIGN PATENT DOCUMENTS

| | | | |
|---|---|---|---|
| 380022 | 8/1964 | Switzerland | 414/619 |

*Primary Examiner*—Leslie J. Paperner
*Attorney, Agent, or Firm*—Oliver D. Olson

[57] ABSTRACT

The wheeled frame remaining after removal therefrom of a detachable cargo container is gripped by clamping mechanism of a carrying unit mounted on a lift truck, then raised above the ground and pivoted from its normal horizontal position to a vertical position for transport to a multiple storage unit. The clamping mechanism is mounted for movement along an elongated boom the inner end of which is mounted on the vertically movable carriage of a lift truck for pivotal movement of the boom between horizontal and vertical positions.

20 Claims, 10 Drawing Figures

WHEELED TRAILER FRAME CARRYING UNIT ATTACHMENT FOR LIFT TRUCK

This application is a continuation of application Ser. No. 174,519, filed Aug. 1, 1980, abandoned.

BACKGROUND OF THE INVENTION

This invention relates to trailers of the detachable cargo container type, and more particularly to apparatus for transporting to storage the wheeled frames of such trailers after removal of the storage container.

After removal of the detachable cargo container from the wheeled frame, commonly known in the trade as a chassis, at a railroad or ship loading site, it has been the practice heretofore that the wheeled frame is left at the site in its normal, wheel-supported, horizontal position. Although some effort generally is made to leave the frames in a location which minimizes interference with normal movement of trucks and other vehicles at the site, the large numbers of wheeled frames so stored necessarily take up an excessive amount of valuable space, while also presenting obstacles to normal traffic. Moreover, since they are unconfined and readily accessible, they are easily stolen.

The patent application of Joseph L. Riley, Ser. No. 69,563, filed Aug. 24, 1979 for METHOD AND SYSTEM FOR STORING WHEELED FRAMES OF DETACHABLE CARGO CONTAINER TYPE TRAILERS, now abandoned, has common assignee with this invention. The carrying unit described in the patent application is supported by a large size tractor and, although it performs its intended functions very well, its size and lifting capacity are much greater than required for most trailer frames.

SUMMARY OF THE INVENTION

In its basic concept, this invention provides a trailer frame carrying unit in which frame holding mechanism is mounted on an elongated boom which is supported on a vertically movable carriage on a vehicle for adjustment of the boom between horizontal and vertical positions.

It is by virtue of the foregoing basic concept that the principal objective of this invention is achieved; namely to provide a trailer frame carrying unit of considerably reduced size and cost as compared with the carrying unit described in the patent application aforesaid.

Another object of this invention is to provide a trailer frame carrying unit of the class described which is capable of attachment to the carriages of conventional lift trucks, with minimum modification of the latter.

A further object of this invention is the provision of a trailer frame carrying unit of the class described which is capable of attachment to and detachment from lift trucks with speed and facility to accommodate use of the lift truck for diverse purposes.

The foregoing and other objects and advantages of this invention will appear from the following detailed description, taken in connection with the accompanying drawings of a preferred embodiment.

DESCRIPTION OF THE PREFERRED EMBODIMENT

Figure 2:
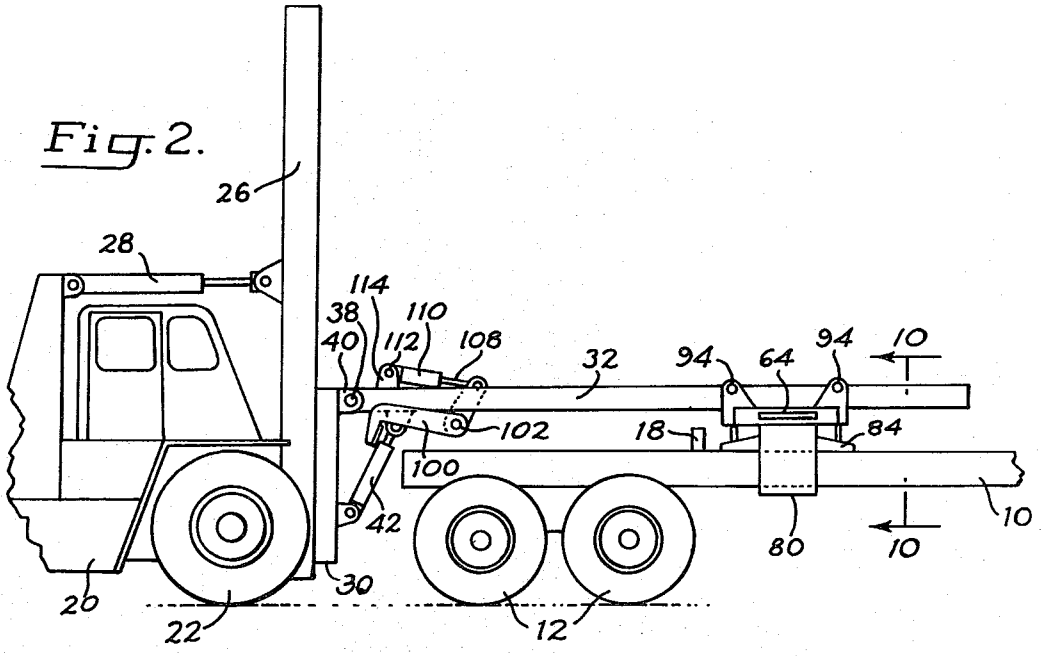
FIG. 2 is a fragmentary side elevation, similar to FIG. 1, showing the carrying unit in its initial trailer frame clamping position.

The drawings illustrate a typical wheeled frame of a detachable cargo container type trailer. It includes an elongated frame 10 supported at its rearward end by a tandem axle dual wheel assembly 12. As is well known, the tandem axle assembly is adjustable longitudinally of the frame to selected load bearing positions, to comply with various highway regulations. The forward end of the frame supports a fifth wheel mounting assembly 14 for coupling to a powered tractor. A pair of laterally spaced, vertically adjustable jacks 16 extend downward from the forward portion of the frame to support the latter in substantially horizontal position when uncoupled from the tractor. Transverse frame members 18 serve to mount a detachable cargo container (not shown).

Although the trailer frame carrying unit of this invention may be integrated permanently with a vehicle having a vertically movable carriage, it is capable of attachment to a wide variety of types and sizes of conventional lift trucks, a typical form of which is illustrated in the drawings. Thus, the lift truck includes a frame 20 supported on front power driven and rear steerable wheels 22 and 24, respectively. An elongated mast 26 is mounted pivotally adjacent its lower end on the front end of the vehicle frame and is supported for slight adjustment from vertical by such means as an hydraulic piston-cylinder unit 28 which pivotally interconnects the vehicle frame and mast. A carriage 30 is mounted on the mast for vertical movement along the latter, and preferably also laterally relative to the mast, the same being powered by such means a hydraulic piston-cylinder units (not shown) interconnecting the elevator and mast.

Figure 7:
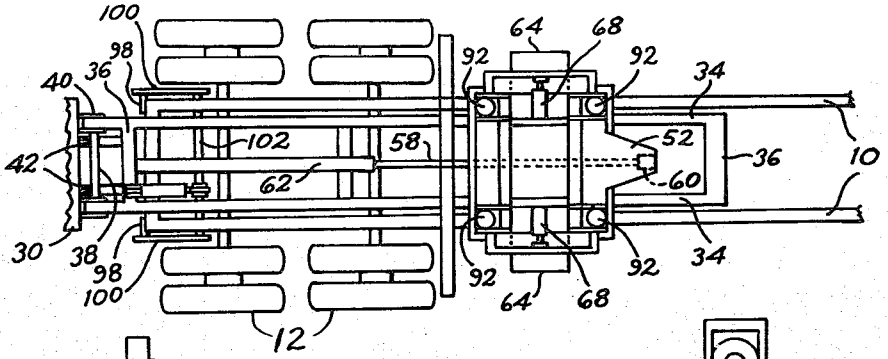
FIG. 7 is a fragmentary plan view as viewed in the direction of arrows 7—7 in FIG. 4.
Figure 6:
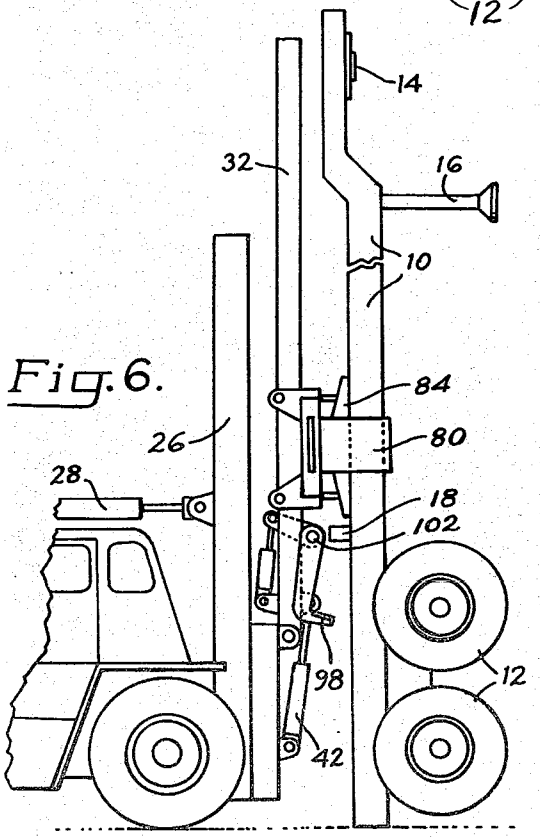
FIG. 6 is a fragmentary, foreshortened side elevation, similar to FIG. 5, showing the carrying unit lowered from the position of FIG. 5 to place the rear end of the trailer frame on the ground for storage in vertical position.

In accordance with this invention, an elongated boom 32 is connected pivotally at its inner end to the lift truck carriage 30 and is supported for adjustment between horizontal and vertical positions. Referring to FIG. 7 of the drawings, the boom is in the form of a framework of a pair of laterally spaced elongated I-beams 34 interconnected by longitudinally spaced transverse beams 36. The rearward ends of the longitudinal beams are connected pivotally to the left truck carriage 30, as by a transverse shaft 38 which extends through the beams and registering brackets 40 projecting forwardly from the lift truck carriage.

Power means is provided for moving the boom between horizontal and vertical positions. In the embodiment illustrated, such means comprises a pair of hydraulic piston-cylinder units 42 spaced apart laterally and connected pivotally at their lower ends to laterally spaced brackets 44 on the lift truck carriage, by means of pivot shafts 46. The upper ends of the piston-cylinder units are connected pivotally, by pivot shafts 48 to brackets 50 projecting downward from the laterally spaced longitudinal beams 36 of the elongated boom.

Figure 10:
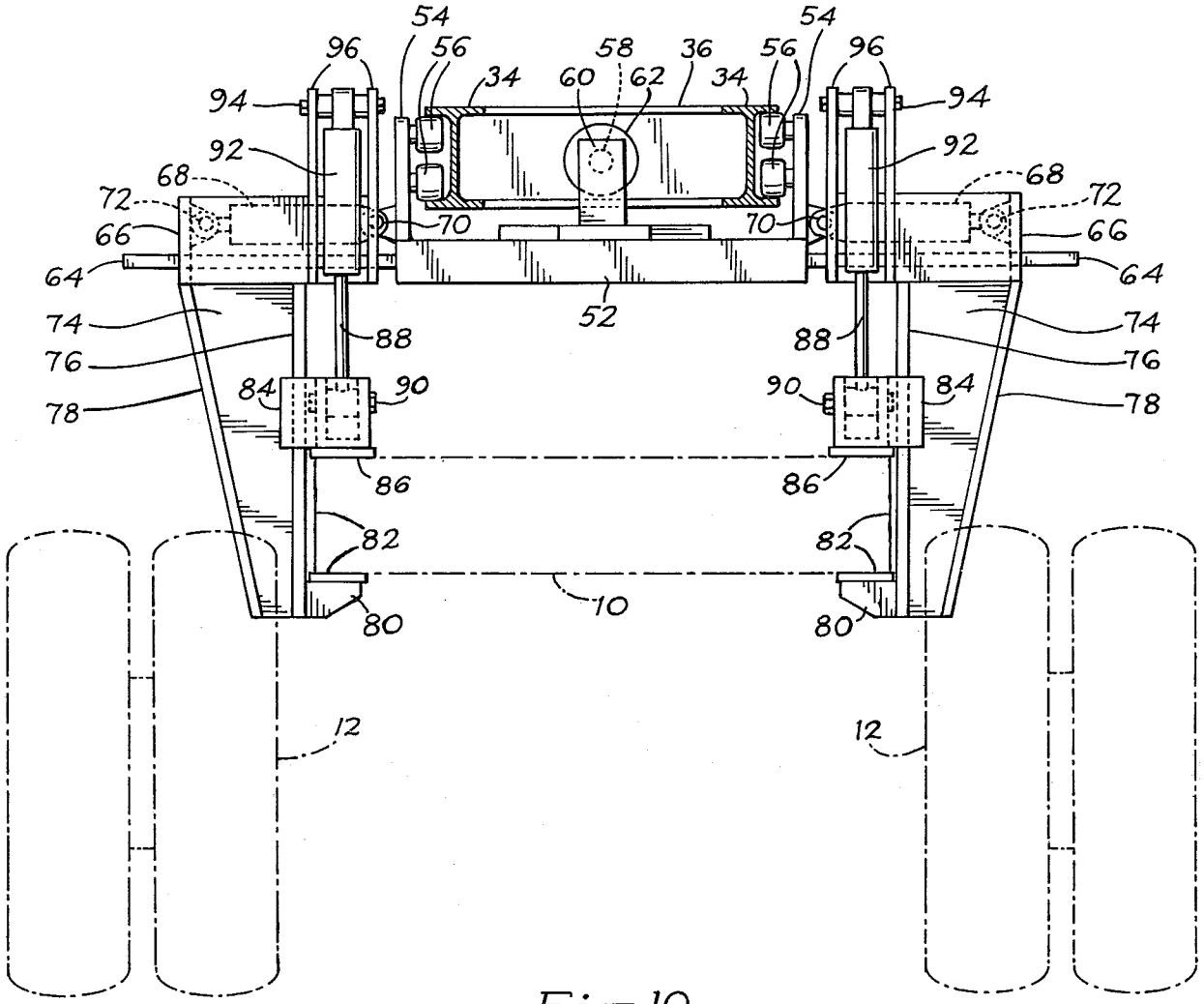
FIG. 10 is a front vertical section, on an enlarged scale, taken on the line 10—10 in FIG. 2, the wheeled trailer frame being shown in broken lines.

The elongated boom supports a trailer frame holding mechanism, preferably for movement along the length of the boom. Referring primarily to FIG. 10 of the drawings, the holding mechanism includes a central base 52 formed of structural plates to which is secured a pair of laterally spaced, upstanding side plates 54. Each side plate mounts a plurality of pairs of rollers 56 proportioned and arranged to fit within the outer side of the associated I-beam 34 and to bear against the upper and lower inner surfaces of the beam. The base thus forms a carriage which is movable along the length of the boom.

Power means is provided for moving the base carriage. In the embodiment illustrated, the power means is provided by an elongated, hydraulic piston-cylinder unit. As illustrated (FIG. 7), the piston-cylinder unit extends along the longitudinal centerline of the boom and the outer end of the piston rod 58 thereof is secured to a bracket 60 projecting upwardly from the base carriage 52. The end of the cylinder 62 of the unit opposite the piston rod is connected to the rearward transverse beam 36 of the boom.

Thus, by the application of hydraulic fluid under pressure selectively to the opposite ends of the cylinder 62, the base carriage 52 is movable along the length of the boom.

Projecting laterally from the opposite sides of the base 52 are transversely elongated guide plates 64. Mounted upon each guide plate for lateral adjustment relative thereto is a clamp jaw carriage 66. Each carriage is moved laterally by means of an hydraulic piston-cylinder unit 68. As illustrated, the inner end of the cylinder of each unit is connected by a pivot shaft 70 to the base carriage. The outer end of the piston rod of the unit is connected by a pivot shaft 72 to the associated clamp jaw carriage 66.

Projecting downward from each of the clamp jaw carriages is an elongated fixed clamp arm. As illustrated, each clamp arm is made up of a plurality of plates 74 spaced apart by reinforcing inner and outer webs 76 and 78, respectively. At the lower end of each clamp arm is secured an inwardly projecting clamp jaw plate 80. The upper surface of the jaw plate and a confronting inner vertical surface of the clamp arm web 76 mount rubber pads 82 to provide protecting and gripping surfaces.

Associated cooperatively with each of the fixed clamp jaws is a vertically adjustable clamp jaw. It includes an elongated jaw frame 84 positioned across the inner surface of the clamp arm and provided with spaced guide grooves slidably receiving the ends of the vertical webs 76 of the associated clamp arm. Its under surface mounts a rubber pad 86.

The downwardly projecting ends of the piston rods 88 of a pair of hydraulic piston-cylinder units are connected to the lateral ends of each jaw frame 84, as by means of pivot bolts 90. The ends of the associated hydraulic cylinders 92 of the units opposite the piston rods are connected by pivot bolts 94 to the lateral ends of a pair of spaced flanges 96 projecting upwardly from the associated clamp jaw carriage 66.

Figure 1:
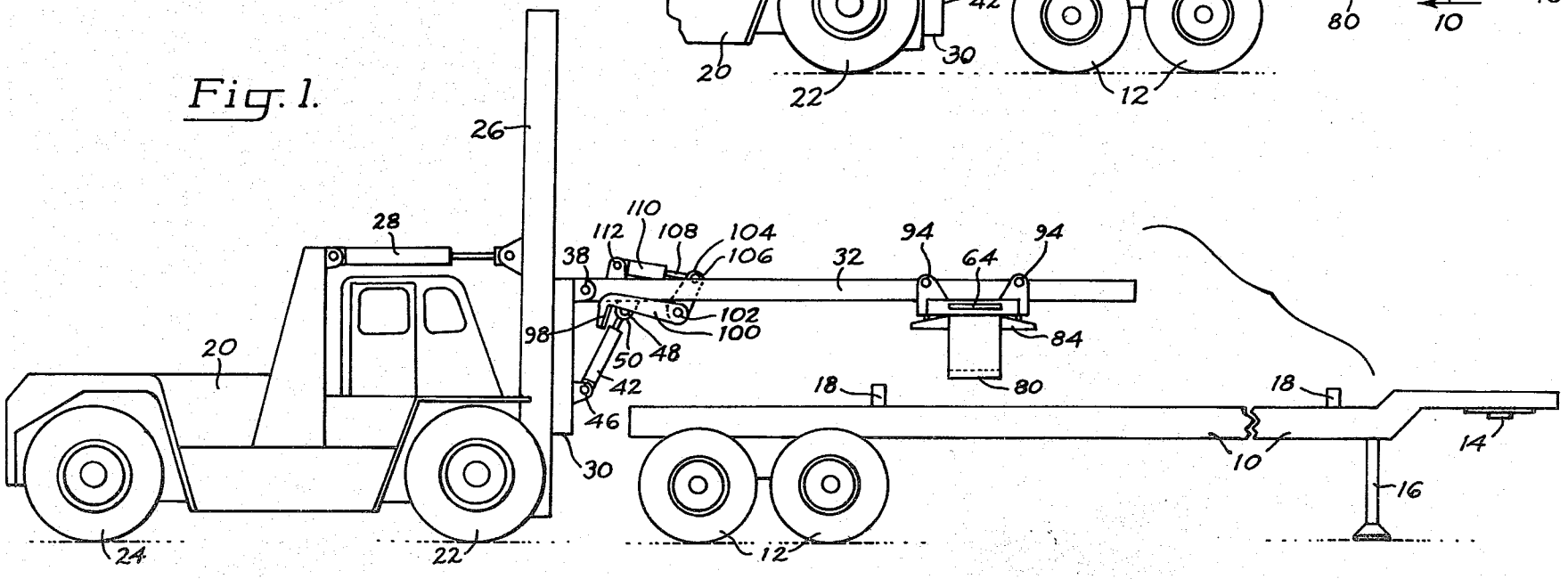
FIG. 1 is a fragmentary, foreshortened side elevation showing a trailer frame carrying unit attachment embodying the features of this invention, the same being mounted on the carriage of a lift truck and adjusted to an initial position preparatory to clamping a trailer frame thereto.

As illustrated, for example in FIG. 1, the vertically adjustable clamp jaw frame 84 is about twice the width of the fixed clamp jaw plate 80. This provides a wide clamping area for gripping a trailer frame 10.

Means preferably is provided for assisting the clamping mechanism in supporting a trailer frame during transport to and from a storage facility. For this purpose there is illustrated (FIG. 7) a pair of laterally spaced trailer support pads 98 located one adjacent each side of the boom 32 on the outer side thereof. Each pad is supported by an arm 100 of a bell crank lever. The arms are secured to a transverse pivot shaft 102 journaled on the boom 32. A second bell crank arm 104 also is secured to the shaft angularly with respect to the first pair of arms 98, and is connected at its outer end by a pivot pin 106 to the piston rod 108 of an hydraulic piston-cylinder unit. The end of the cylinder 110 of the unit opposite the piston rod is connected by a pivot shaft 112 to a bracket 114 secured to the boom 32.

Figure 5:
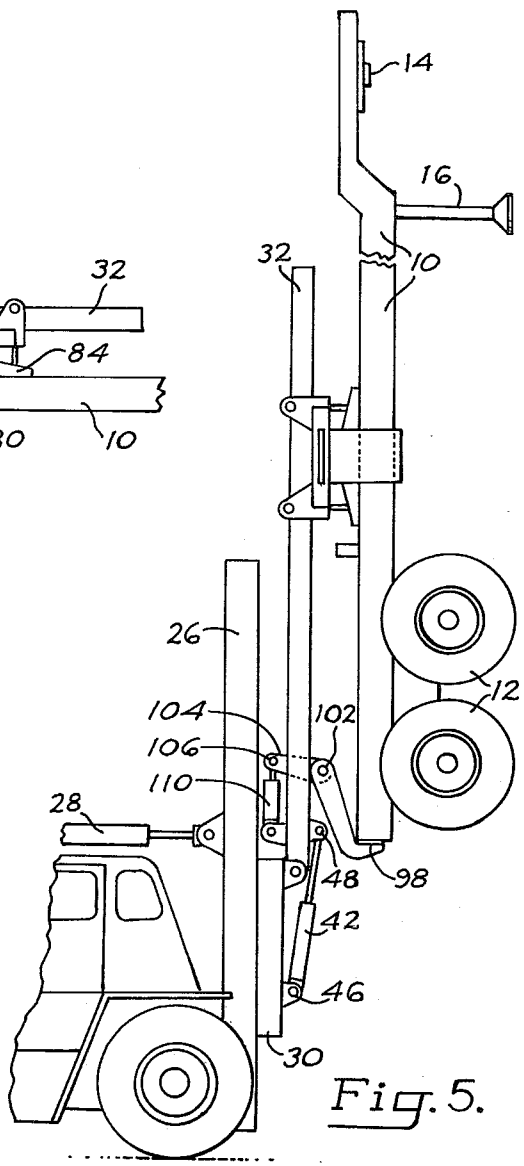
FIG. 5 is a fragmentary, foreshortened side elevation showing the carrying unit and clamped trailer frame swung from the horizontal position of FIG. 4 to vertical position for transport to storage.
Figure 3:
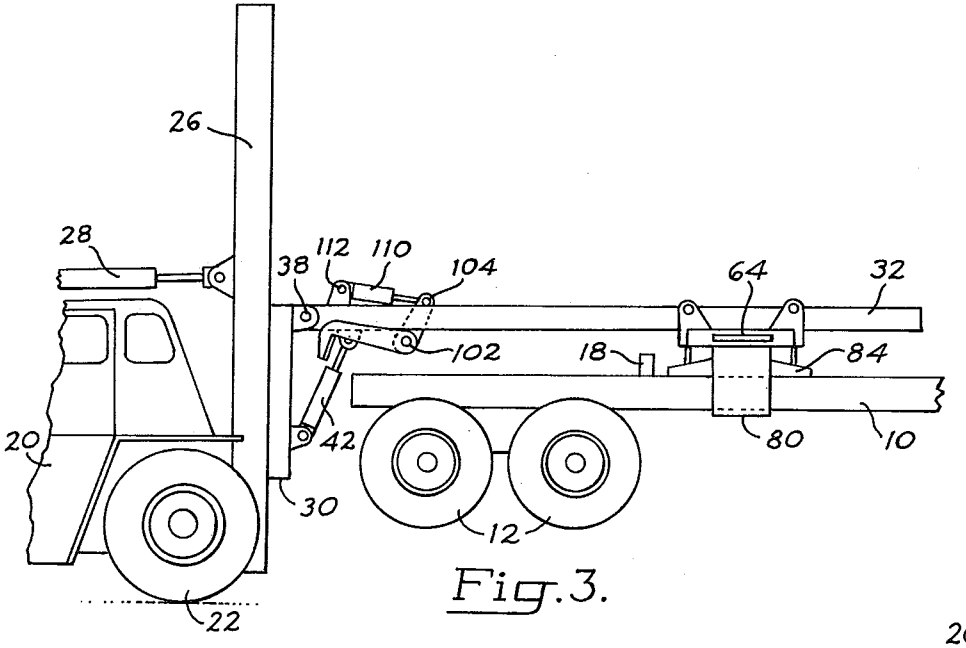
FIG. 3 is a fragmentary side elevation, similar to FIG. 2, showing the carrying unit in position elevating the trailer frame above ground.
Figure 4:
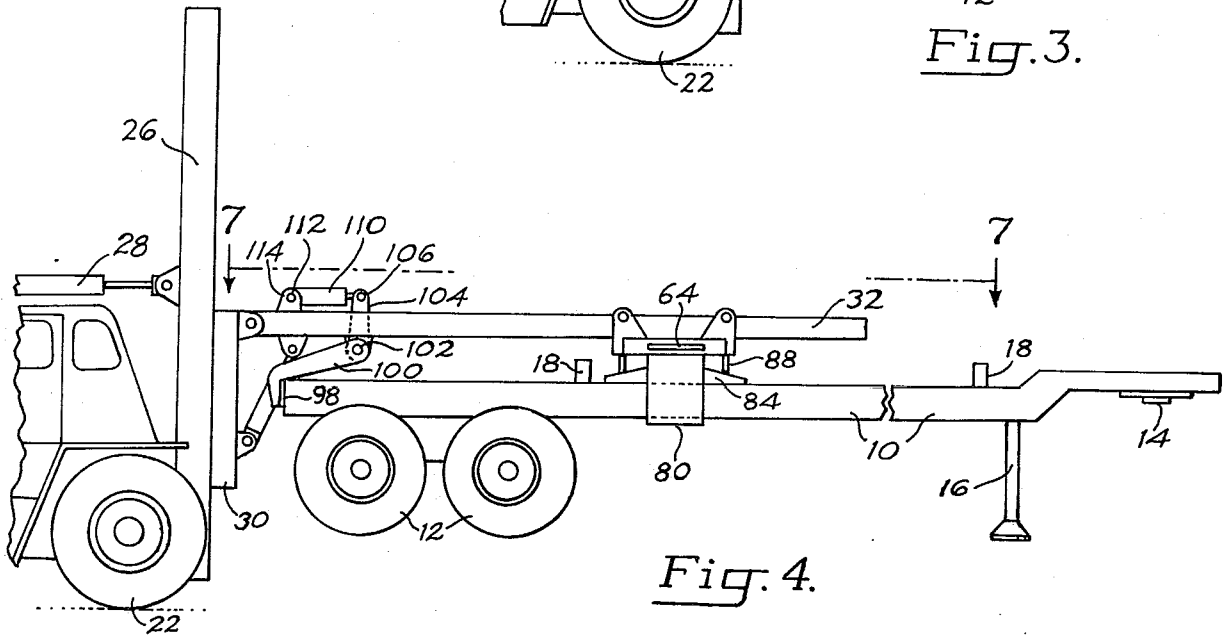
FIG. 4 is a fragmentary, foreshortened side elevation, similar to FIG. 3, showing the carrying unit with the raised trailer frame moved longitudinally into abutment with support mechanism.

Thus, by the application of hydraulic fluid under pressure to the piston rod end of the cylinder 110, the trailer abutment pads 98 are moved from the retracted position illustrated in FIGS. 1–3 and 6 to the extended position illustrated in FIGS. 4 and 5. In this extended position the pads are disposed for abutment by the rear end of a trailer frame, whereby to assist the clamping mechanism in supporting the trailer frame during transport to and from a storage facility.

The operation of the trailer frame carrying unit described hereinbefore is as follows: Let it be assumed that the unit is mounted on the vertically movable carriage 30 of a conventional lift truck, with the forks of the lift truck having previously been removed. The mounting of the unit on the lift truck carriage is achieved by means of the pivot connections 38 and 46 previously described.

Referring to FIG. 1 of the drawings, the lift truck operator maneuvers the vehicle to bring it in substantial longitudinal alignment with the trailer frame 10 resting horizontally upon a loading or unlading site. The operator then directs hydraulic fluid under pressure to the boom support cylinders 42 to pivot the boom to the horizontal position illustrated in FIG. 1. To insure that the trailer clamping mechanismis disposed a spaced distance above the trailer frame, the operator elevates the lift truck carriage 30 on the mast 26 to the position illustrated in FIG. 1.

In the event the boom 32 is displaced slightly laterally relative to the longitudinal centerline of the trailer frame, the operator may either relocate the vehicle to more accurate alignment with the trailer frame, or move the lift truck carriage laterally, if such lateral adjustment of the carriage is provided for.

The operator now directs hydraulic fluid under pressure to the cylinders 68 to move the carriages 66 and the opposed clamp jaws farther apart laterally then the width of the trailer frame to be clamped. Hydraulic fluid under pressure also is applied to the cylinders 92 to retract the latter and the attached clamping jaws 84 upwardly to maximum distance from the fixed jaws 80 of the associated units.

The operator now lowers the lift truck carriage 30 (FIG. 2) to bring the clamp jaws into horizontal alignment with the trailer frame, and then applies hydraulic fluid under pressure to the cylinders 68 to move the clamp jaw carriages toward each other until the sides of the trailer frame are brought into abutment with the vertical rubber pads 82. The lift truck carriage then is elevated sufficiently to bring the fixed clamp jaws 80 upwardly into abutment with the underside of the trailer frame, whereupon hydraulic fluid under pressure is applied to the cylinders 92 to lower the movable clamp jaws 84 into clamping abutment with the upper sides of the trailer frame.

Since the brakes on the tandem wheels 12 of the trailer are set automatically upon disengagement from the towing tractor, the operator now elevates the lift truck carriage and the clamped trailer frame sufficiently to raise the tandem wheels above ground (FIG. 3). The trailer support pads 98 then are extended to operative position (FIG. 4) by applying hydraulic fluid under pressure to the piston rod end of the cylinder 110. The clamp base carriage 52 then is moved rearward along the boom by application of hydraulic fluid under pressure to the piston rod end of the cylinder 62, until the rearward end of the trailer frame is brought into abutment with the support pads 98. The trailer frame thus is supported by the clamping mechanism and the support pads.

The operator now applies hydraulic fluid under pressure to the piston end of the boom cylinders 42 to cause extension of the associated piston rods and pivoting of the boom 32 to the vertical position illustrated in FIG. 5. The trailer frame 10 thus is moved with the boom to the vertical position illustrated. The lift truck now may be driven to an appropriate site for storage of the trailer frame in the vertical position. At the storage site the lift truck operator first retracts the trailer support pads 98, by applying hydraulic fluid under pressure to the end of the cylinder 110 opposite its associated piston rod, and then lowers the lift truck carriage 30 until the rearward end of the trailer frame is rested upon the ground at the storage site. The clamping mechanism then is released from the trailer frame and the lift truck moved away.

Figure 9:
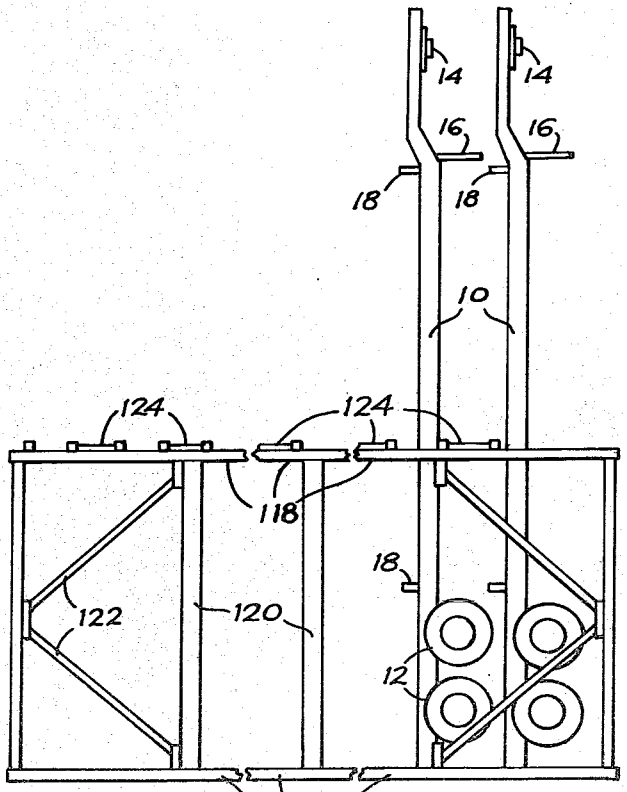
FIG. 9 is a foreshortened side elevation as viewed from the right in FIG. 8.
Figure 8:
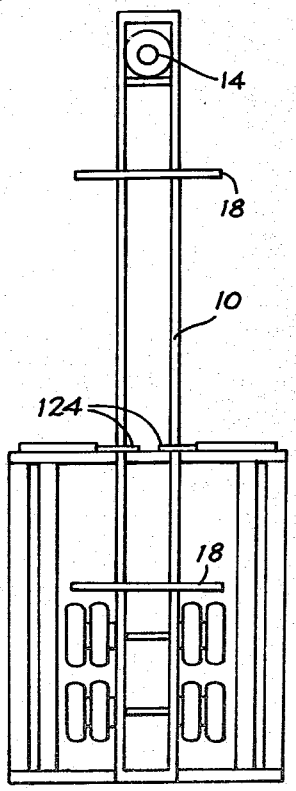
FIG. 8 is a front elevation of a storage unit illustrating the manner of supporting for storage a plurality of wheeled frames of detachable cargo container type trailers.

Referring now to FIGS. 8 and 9 of the drawings, the storage unit illustrated therein is the same as the storage unit described in the patent application identified hereinbefore, and therefore is described only briefly herein. It includes a pair of laterally spaced side walls in the form of open frameworks. Thus, each includes a longitudinal base beam 116, a longitudinal top beam 118 and a plurality of longitudinally spaaed vertical beams 120 interconnecting them. Diagonal brace beams 122 may be provided, extending between adjacent vertical beams, to increase the structural stability of the framework.

Means is provided for forming the framework structure into a plurality of longitudinally disposed compartments each adapted to receive and store a wheeled trailer frame. For this purpose, as illustrated, a plurality of pairs of containment gates 124 are positioned at longitudinally spaced intervals along the length of the framework structure for extension and retraction relative to a central channel defined by additional beams of the framework. Each pair of containment gates thus forms with the side walls of the framework structure a compartment in which to contain a trailer frame.

Each of the containment gates of each pair illustrated are retractable laterally outward so that the central channel of the framework is uninterrupted, whereby to allow the passage of a trailer frame along the channel. Thus, the first trailer frame to be stored is moved by the lift truck, as previously described, to the rearwardmost position, to the far right in FIG. 9, for deposit in the rearwardmost compartment. The pair of containment gates associated with said compartment then are extended laterally inward to the position illustrated in FIG. 8, to intercept the central channel and present an obstructing gate which prevents retraction of the trailer frame in the forward direction along the central channel. Thus, the pair of containment gates form with the associated side walls of the storage unit a storage compartment for the trailer frame.

It will be understood that trailer frames are introduced into the storage unit and deposited one at a time successively from the rearwardmost compartment to the forwardmost compartment. Removal of the trailer frames is accomplished in reverse order; namely, one at a time from the forwardmost compartment to the rearwardmost compartment.

It will be apparent to those skilled in the art that various changes may be made in the size, shape, type, number and arrangement of parts described hereinbefore without departing from the spirit of this invention and the scope of the appended claims.

Having now described by invention and the manner in which it may be used, I claim:

1. A trailer frame carrying unit for carrying the empty elongated wheeled frame of a trailer of the detachable cqrgo container type having a wheel assembly mounted adjacent its rearmost end, the trailer frame carrying unit comprising, in combination with a powered vehicle mounting a vertically movable carriage:

(a) an elongated boom secured at one end to the carriage for pivotal movement between horizontally and vertically extending positions, (b) power means engaging the boom for moving the latter between said positions, and (c) trailer frame holding means mounted on the boom and arranged to releasably clamp a trailer frame thereto, to move the secured trailer frame vertically by moving the carriage vertically, and to move the trailer frame between horizontal and vertical positions by pivoting the boom between horizontally and vertically extending positions, the holding means including a base mounted on the boom and a pair of spaced apart frame-engaging clamp jaw members mounted on the base for movement one toward and away from the other to a clamping position closely adjacent each other for releasably clamping between them the thickness dimension of the frame of a trailer, (d) said boom and trailer frame holding means configured and arranged to clamp the trailer frame forwardly of the wheel assembly for moving the clamped trailer frame selectively between its normal ground-supported horizontal position and a substantially vertical position with its forwardmost end extending upwardly and its rearmost, wheeled end elevated above ground for transport.

2. The combination of claim 1 including trailer frame support means mounted on the boom for movement between an extended position for abutment by the rearward end of a trailer frame secured to the holding means and a retracted position displaced from the trailer frame.

3. The combination of claim 2 including power means interengaging the boom and support means for moving the latter between said extended and retracted positions.

4. The combination of claim 1 wherein the boom and trailer frame holding means are also configured and arranged to move the vertically extending trailer frame from its transport position elevated above ground downwardly to the ground for resting the frame upon its rear end in storage position.

5. For use with a lift truck having a vertically movable carriage, an attachment therefor for carrying the empty elongated wheeled frame of a trailer of the detachable cargo container type having a wheel assembly mounted adjacent its rearmost end, the attachment comprising:

(a) an elongated boom, (b) connecting means on one end of the boom arranged for releasable attachment to a lift truck carriage for movement of the boom between horizontally and vertically extending positions, (c) power means engaging the boom for moving the latter between said positions, and (d) trailer frame holding means mounted on the boom and arranged to secure releasably thereto the frame of the trailer, whereby the trailer frame may be moved vertically relative to ground by moving the carriage vertically, and the trailer frame may be moved between horizontal and vertical positions by moving the boom between horizontally and vertically extending positions, the holding means including a base mounted on the boom and a pair of spaced apart frame-engaging clamp jaw members mounted on the base for movement one toward and away from the other to a clamping position closely adjacent each other for releasably clamping between them the thickness dimension of the frame of a trailer forwardly of the wheel assembly for moving the clamped trailer frame selectively between its normal ground-supported horizontal position and a substantailly vertical position with its forwardmost end extending upwardly and its rearmost, wheeled end elevated above ground for transport.

6. The attachment of claim 5 including trailer frame support means mounted on the boom for movement between an extended position for abutment by the rearward end of a trailer frame secured to the holding means and a retracted position displaced from the trailer frame.

7. The combination of claim 6 including power means interengaging the base and each movable jaw for moving the latter relative to its associated jaw.

8. A trailer frame carrying unit for carrying the empty elongated wheeled frame of a trailer of the detachable cargo container type having a wheel assembly mounted adjacent its rearmost end, the carrying unit comprising, in combination with a powered vehicle mounting a vertically movable carriage:

(a) an elongated boom secured at one end to the carriage for pivotal movement between horizontally and vertically extending positions, (b) power means engaging the boom for moving the latter between said positions, and (c) trailer frame holding means mounted on the boom and arranged to releasably secure a trailer frame thereto, to move the secured trailer frame vertically by moving the carriage vertically, and to move the trailer frame between horizontal and vertical positions by pivoting the boom between horizontally and vertically extending positions, the trailer frame holding means comprising a base mounted on the boom, and a pair of laterally spaced frame engaging members mounted on the base for lateral movement toward and away from each other for releasably securing between them the frame of a trailer, each frame engaging member comprising a clamp having spaced jaws one movable toward and away from the other for releasably clamping between them a side portion of the frame of a trailer forwardly of the wheel assembly for moving the clamped trailer frame selectively between its normal ground-supported horizontal position and a substantially vertical position with its forwardmost end extending upwardly and its rearmost, wheeled end elevated above ground for transport.

9. A trailer frame carrying unit comprising, in combination with a powered vehicle mounting a vertically movable carriage:

(a) an elongated boom secured at one end to the carriage for pivotal movement between horizontally and vertically extending positions, (b) power means engaging the boom for moving the latter between said positions, and (c) trailer frame holding means mounted on the boom and arranged to releasably secure a trailer frame thereto, to move the secured trailer frame vertically by moving the carriage vertically, and to move the trailer frame between horizontal and vertical positions by pivoting the boom between horizontally and vertically extending positions, the trailer frame holding means comprising a base carriage mounted on the boom for movement longitudinally thereof, and a pair of laterally spaced frame-engaging members mounted on the base carriage for lateral movement toward and away from each other for releasably securing between them the frame of a trailer.

10. The combination of claim 9 including power means interengaging the boom and base carriage for moving the latter.

11. A trailer frame carrying unit comprising, in combination with a powered vehicle mounting a vertically movable carriage:

(a) an elongated boom secured at one end to the carriage for pivotal movement between horizontally and vertically extending positions, (b) power means engaging the boom for moving the latter between said positions, and (c) trailer frame holding means mounted on the boom and to releasably secure a trailer frame thereto, to move the secured trailer frame vertically by moving the carriage vertically, and to move the trailer frame between horizontally and vertically extending positions, the holding means comprising a carriage mounted on the boom for movement longitudinally thereof, power means interengaging the boom and carriage for moving the latter, a pair of laterally spaced frame-engaging clamps mounted on the carriage for lateral movement toward and away from each other, power means interengaging the carriage and clamps for moving the latter, each clamp having spaced jaws one movable toward and away from the other for releasably clamping between them a side portion of the frame of a trailer, and power means interengaging the carriage and each movable jaw for moving the latter relative to its associated jaw.

12. For use with a lift truck having a vertically movable carriage, an attachment therefor for carrying the empty elongated wheeled frame of a trailer of the detachable cargo container type having a wheel assembly mounted adjacent its rearmost end, the attachment comprising:

(a) an elongated boom, (b) connecting means on one end of the boom arranged for releasable attachment to a lift truck carriage for movement of the boom between horizontally and vertically extending positions, (c) power means engaging the boom for moving the latter between said positions, and (d) trailer frame holding means mounted on the boom and arranged to secure releasably thereto the frame of the trailer, whereby the trailer frame may be moved vertically relative to the ground by moving the carriage vertically and the trailer frame may be moved between horizontal and vertical positions by moving the boom between horizontally and vertically extending positions, the holding means comprising a base mounted on the boom, and a pair of laterally spaced frame-engaging members mounted on the base for lateral movement toward and away from each other for releasably securing between them the frame of a trailer, each frame-engaging member comprising a clamp having spaced jaws one movable toward and away from the other for releasably clamping between them a side portion of a frame of a trailer forwardly of the wheel assembly for moving the clamped trailer frame selectively between its normal ground-supported horizontal position and a substantially vertical position with its forwardmost end extending upwardly and its rearmost, wheeled end elevated above ground for transport.

13. A trailer frame carrying unit attachment for lift truck having a vertically movable carriage, the attachment comprising:

(a) an elongated boom, (b) connecting means on one end of the boom arranged for releasable attachment to a lift truck carriage for movement of the boom between horizontally and vertically extending positions, (c) power means engaging the boom for moving the latter between said positions, (d) trailer frame holding means mounted on the boom and arranged to secure releasably thereto the frame of the trailer, whereby the trailer may be moved vertically relative to ground by moving the carriage vertically, and the trailer frame may be moved between horizontal and vertical positions by moving the boom between horizontally and vertically extending positions, the holding means comprising a base carriage mounted on the boom for movement longitudinally thereof, and a pair of laterally spaced frame-engaging members mounted on the base carriage for lateral movement toward and away from each other for releasably securing between them the frame of a trailer.

14. A trailer frame carrying unit attachment for a lift truck having a vertically movable carriage, the attachment comprising:

(a) an elongated boom, (b) connecting means on one end of the boom arranged for releasable attachment to a lift truck carriage for movement of the boom between horizontally and vertically extending positions, (c) power means engaging the boom for moving the latter between said positions, and (d) trailer frame holding means mounted on the boom and arranged to secure releasably thereto the frame of the trailer, whereby the trailer frame may be moved vertically relative to ground by moving the carriage vertically, and the trailer frame may be moved between horizontal and vertical positions by moving the boom between horizontally and vertically extending positions, the holding means comprising a carriage mounted on the boom for movement longitudinally thereof, power means interengaging the boom and carriage for moving the latter, a pair of laterally spaced frame-engaging clamps mounted on the carriage for lateral movement toward and away from each other, power means interengaging the carriage and clamps for moving the latter, each clamp having spaced jaws one movable toward and away from the other for releasably clamping between them a side portion of the frame of a trailer, and power means interengaging the carriage and each movable jaw for moving the latter relative to its associated jaw.

15. A trailer frame carrying unit for carrying the empty elongated wheeled frame of a trailer of the detachable cargo container type having a wheel assembly mounted adjacent its rearmost end, the trailer frame carrying unit comprising, in combination with a powered vehicle mounting a vertically movable carriage, trailer frame holding means supported by the carriage for movement relative thereto and arranged to releasably clamp a trailer frame thereto, to move the secured trailer frame vertically by moving the carriage vertically, and to move the trailer frame between horizontal and vertical positions by moving the holding means relative to the carriage, the holding means including a base supported by the carriage and a pair of spaced apart frame-engaging clamp jaw members mounted on the base for movement one toward and away from the other to a clamping position closely adjacent each other for releasably clamping between them the thickness dimension of the frame of a trailer forwardly of the wheel assembly for moving the clamped trailer frame selectively between its normal ground-supported horizontal position and a substantially vertical position with its forwardmost extending upwardly and its rearmost, wheeled end elevated above ground for transport.

16. The combination of claim 15 including trailer frame support means supported by the carriage for movement between an extended position for abutment by the rearward end of a trailer frame secured to the holding means and a retracted position displaced from the trailer frame.

17. The combination of claim 16 including power means interengaging the carriage and support means for moving the latter between said extended and retracted positions.

18. The combination of claim 15 wherein the holding means is also arranged to move the vertically extending trailer frame from its transport position elevated above ground downwardly to the ground for resting the frame upon its rear end in storage position.

19. For use with a lift truck having a vertically movable carriage, an attachment therefor for carrying the empty elongated wheeled frame of a trailer of the detachable cargo container type having a wheel assembly mounted adjacent its rearmost end, the attachment comprising:

(a) trailer frame holding means, and (b) connecting means on the holding means arranged for releasable attachment to a lift truck carriage for movement of the holding means relative to the carriage, (c) the trailer frame holding means being arranged to secure releasably thereto the frame of the trailer, whereby the trailer frame may be moved vertically relative to ground by moving the carriage vertically, and the trailer frame may be moved between horizontal and vertical positions by moving the holding means relative to the carriage, the holding means including a base supported by the carriage and a pair of spaced apart frame-engaging clamp jaw members mounted on the base for movement one toward and away from the other to a clamping position closely adjacent each other for releasably clamping between them the thickness dimension of the frame of a trailer forwardly of the wheel assembly for moving the clamped trailer frame selectively between its normal ground-supported horizontal position and a substantially vertical position with its forwardmost end extending upwardly and its rearmost end elevated above ground for transport.

20. The attachment of claim 19 including trailer frame support means arranged for support by the carriage for movement between an extended position for abutment by the rearward end of a trailer frame secured to the holding means and a retracted position displaced from the trailer frame.

* * * * *

UNITED STATES PATENT AND TRADEMARK OFFICE

CERTIFICATE OF CORRECTION

PATENT NO. : 4,437,807

DATED : 20 March 1984

INVENTOR(S) : Lynn F. Perrott

It is certified that error appears in the above-identified patent and that said Letters Patent are hereby corrected as shown below:

Column 7, line 60, "claim 6" should read --claim 8--.

Signed and Sealed this

*Eleventh* Day of *December 1984*

[SEAL]

*Attest:*

GERALD J. MOSSINGHOFF

*Attesting Officer* *Commissioner of Patents and Trademarks*